US010738626B2

(12) United States Patent
Burdgick et al.

(10) Patent No.: US 10,738,626 B2
(45) Date of Patent: Aug. 11, 2020

(54) CONNECTION ASSEMBLIES BETWEEN TURBINE ROTOR BLADES AND ROTOR WHEELS

(71) Applicant: General Electric Company, Schenectady, NY (US)

(72) Inventors: Steven Sebastian Burdgick, Schenectady, NY (US); Thomas Joseph Farineau, Burnt Hills, NY (US); Timothy Scott McMurray, Rotterdam Junction, NY (US); John James Ligos, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 98 days.

(21) Appl. No.: 15/791,469

(22) Filed: Oct. 24, 2017

(65) Prior Publication Data

US 2019/0120069 A1 Apr. 25, 2019

(51) Int. Cl.

| | |
|---|---|
| ***F01D 5/32*** | (2006.01) |
| ***F01D 5/30*** | (2006.01) |
| *F01D 5/14* | (2006.01) |
| *F01D 5/02* | (2006.01) |

(52) U.S. Cl.

CPC ..... *F01D 5/326* (2013.01); *F01D 5/3007* (2013.01); *F01D 5/323* (2013.01); *F01D 5/02* (2013.01); *F01D 5/147* (2013.01); *F05D 2220/30* (2013.01); *F05D 2230/60* (2013.01)

(58) Field of Classification Search

CPC ..... F01D 5/326; F01D 5/3007; F01D 5/02; F01D 5/147; F05D 2220/30; F05D 2230/60

USPC ..... 416/220 R

See application file for complete search history.

(56) References Cited

U.S. PATENT DOCUMENTS

| | | | | |
|---|---|---|---|---|
| 4,466,776 | A | 8/1984 | Camboulives | |
| 4,711,007 | A | 12/1987 | Conrad | |
| 6,893,224 | B2 | 5/2005 | Murphy | |
| 7,415,763 | B2 * | 8/2008 | Miosga | F01D 5/30 29/889.21 |

(Continued)

FOREIGN PATENT DOCUMENTS

WO 2013/090742 A1 6/2013

OTHER PUBLICATIONS

International Search Report and Written Opinion issued in connection with corresponding PCT Application No. PCT/US2018/047482 dated Jan. 2, 2019.

*Primary Examiner* — Joseph J Dallo
*Assistant Examiner* — Yi-Kai Wang
(74) *Attorney, Agent, or Firm* — Charlotte Wilson; Hoffman Warnick LLC

(57) ABSTRACT

A turbine engine including: rotor blades circumferentially arrayed about a rotor wheel; a connection assembly by which each of the rotor blades connects to the rotor wheel, the connection assembly including: an axially oriented slot formed through a perimeter face of the rotor wheel; a root of the rotor blade installed within the slot, the root being shaped in relation to the slot such that the installation therein forms an axially extending shim cavity between opposing exterior surfaces of the root and the slot; and a shim installed within the shim cavity for restraining movement of the rotor blade relative to the rotor wheel in a radial direction.

19 Claims, 10 Drawing Sheets

(56) References Cited

U.S. PATENT DOCUMENTS

| | | | | |
|---|---|---|---|---|
| 8,821,127 | B1 * | 9/2014 | Knecht | F01D 5/021 29/889.2 |
| 8,870,545 | B2 | 10/2014 | Reghezza et al. | |
| 8,992,180 | B2 | 3/2015 | Agaram et al. | |
| 2005/0254951 | A1 | 11/2005 | Thenaisie et al. | |
| 2006/0275125 | A1 * | 12/2006 | Bibor | F01D 5/081 416/193 A |
| 2008/0253895 | A1 * | 10/2008 | Gekht | F01D 5/323 416/220 R |
| 2009/0060745 | A1 | 3/2009 | Douguet et al. | |
| 2010/0014986 | A1 * | 1/2010 | Traverso | F01D 5/081 416/97 R |
| 2010/0189564 | A1 | 7/2010 | Stone | |
| 2010/0226777 | A1 | 9/2010 | Forgue et al. | |
| 2012/0107125 | A1 * | 5/2012 | Reghezza | F01D 5/3007 416/220 R |
| 2014/0079559 | A1 * | 3/2014 | Luczak | F01D 5/3007 416/248 |
| 2017/0298778 | A1 * | 10/2017 | Twell | F01D 5/3007 |
| 2019/0063229 | A1 * | 2/2019 | Garner | F01D 5/147 |

* cited by examiner

CONNECTION ASSEMBLIES BETWEEN TURBINE ROTOR BLADES AND ROTOR WHEELS

BACKGROUND OF THE INVENTION

This invention relates generally to rotor blades for use in turbine engines, and more specifically, but not by way of limitation, rotor wheel assemblies that promote efficient installation while also reducing certain types of wear.

As will be appreciated, turbine engines (for example, combustion or steam turbine engines) include flowpaths defined through turbine sections or turbines through which a pressurized working fluid is expanded during operation. Within such turbine, alternating rows of static nozzles or stator blades and buckets or rotor blades are axially stacked to interact with the flow of working fluid. The stator blades direct the flow of working fluid onto the rotor blades so to induce rotation about a central axis of the turbine. The rotor blades are connected to a rotor wheel that is connected to a shaft so that this rotation drives the rotation of the shaft, which then may be used to do work, for example, turn the coils of a generator.

Such turbines may include several stages or rows of rotor blades, and the size of these rotor blades generally increases as the rows progress in the downstream direction. The rotor blades within the later stages of the turbine engines, thus, typically have considerable length and weight. Along with the highly contoured shapes of these rotor blades, the considerable size creates certain geometrical or spatial restraints during installation, as well as particular structural and retainment issues for the rotor blades during operation.

Turbine rotor blades connect to the rotor wheel via particular types of connectors or connection assemblies. These typically include a particularly shaped root of the rotor blade—for example, a dovetail or "multi-tang" fir tree shape—that engages a correspondingly shaped slot formed through the outer perimeter of the rotor wheel. Such shaped connectors are effective at providing a number of stress-spreading contact surfaces between the root and the slot, and, once these contact surfaces engage, relative movement between the rotor blade and the rotor wheel is substantially restrained. According to certain conventional designs, such rotor blade and rotor wheel connections are often constructed with a certain degree of "wiggle room", "play" or "excess room" in the radial direction, which allows some freedom of movement relative to the rotor wheel for rotor blades already engaged within the slot.

During high speed operation, it will be appreciated that such excess room in the radial direction does not lead to the rotor blade moving within the connector because the centrifugal forces drive the rotor blade in an outward radial direction and thereby fix it against the contact surfaces within the slot. As will be appreciated, the rotor blade will remain in this position as long as the turbine continues operating at high speed. However, during low speed operation, such as turning gear operation, the excess room allowed in the radial direction results in the rotor blade moving or jostling in this direction as it rotates. This movement is generally undesirable due to the wear it causes to the contact faces of the root and within the slot. However, having the excess room in the connector is nonetheless often necessary to facilitate assembly of the rotor blades. Specifically, some movement or "fanning" of rotor blades is needed during the assembly of the row. One of the reasons for this is that the outer tips of the airfoil of the rotor blade typically have interlocking features. Further, the airfoil portions of the rotor blades may overlap such that the assembly of the last rotor blades in the row is made difficult, if not impossible, unless a certain amount of movement is not maintained within the connectors.

Conventional technology includes the use of springs or, alternatively, overly tight dovetail fits, but each has limitations that are undesirable for use with the longer and heavier rotor blades in the later stages of the turbine. For example, springs may be used, but such springs and forces they needed to provide to radially secure the rotor blades are sizeable, particularly to overcome the 3-o'clock and 9-o'clock moment loading of the rotor blades during slow speed operation. Springs large enough to do this may limit the robustness of the rotor wheel design because the oversized dovetail bottoms required to accomplish this increases the stresses applied to the rotor wheel. Springs also are difficult to install and add to the complexity of the assembly. On the other hand, with overly tight connectors, the relative movement between the rotor blade and rotor wheel that is needed for efficient installation is eliminated.

Given these considerations, novel connection assemblies between rotor blades and rotor wheels, which permit some relative movement during installation but that may be made to restrain such movement once installation is completed, would have considerable economic value.

BRIEF DESCRIPTION OF THE INVENTION

The present application thus describes a turbine engine that include: rotor blades circumferentially arrayed about a rotor wheel; a connection assembly by which each of the rotor blades connects to the rotor wheel, the connection assembly including: an axially oriented slot formed through a perimeter face of the rotor wheel; a root of the rotor blade installed within the slot, the root being shaped in relation to the slot such that the installation therein forms an axially extending shim cavity between opposing exterior surfaces of the root and the slot; and a shim installed within the shim cavity for restraining movement of the rotor blade relative to the rotor wheel in a radial direction.

These and other features of the present application will become apparent upon review of the following detailed description of the preferred embodiments when taken in conjunction with the drawings and the appended claims.

BRIEF DESCRIPTION OF THE DRAWINGS

These and other features of this invention will be more completely understood and appreciated by careful study of the following more detailed description of exemplary embodiments of the invention taken in conjunction with the accompanying drawings, in which.

DETAILED DESCRIPTION OF THE INVENTION

Figure 1:
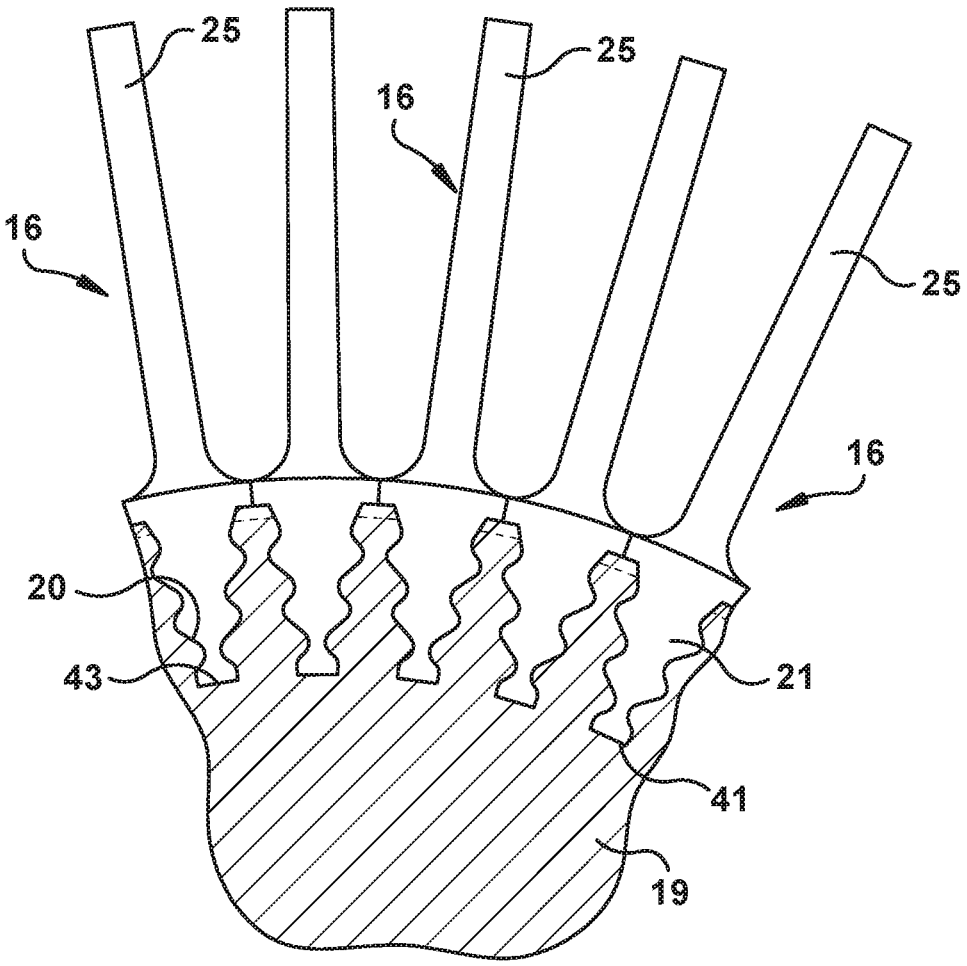
FIG. 1 is a partial sectional view of a circular array of rotor blades disposed in a rotor wheel.
Figure 2:
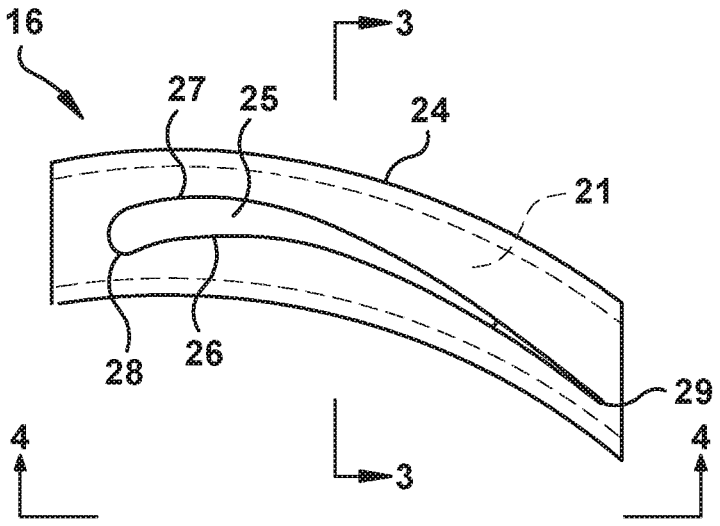
FIG. 2 is a plan view of an exemplary rotor blade.
Figure 3:
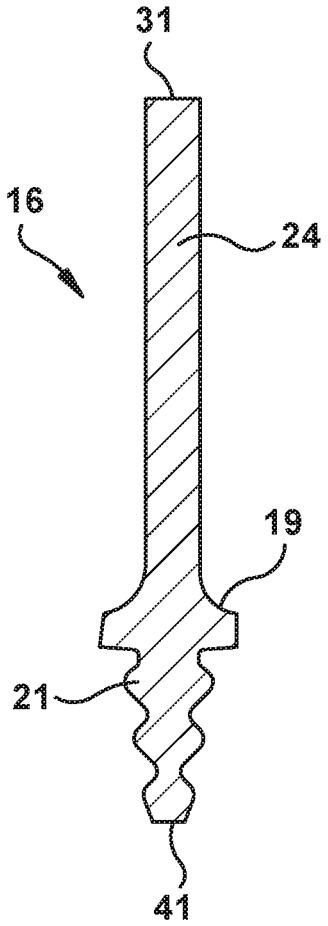
FIG. 3 is an elevation view of the rotor blade shown in FIG. 2 taken along the line 3-3.
Figure 4:
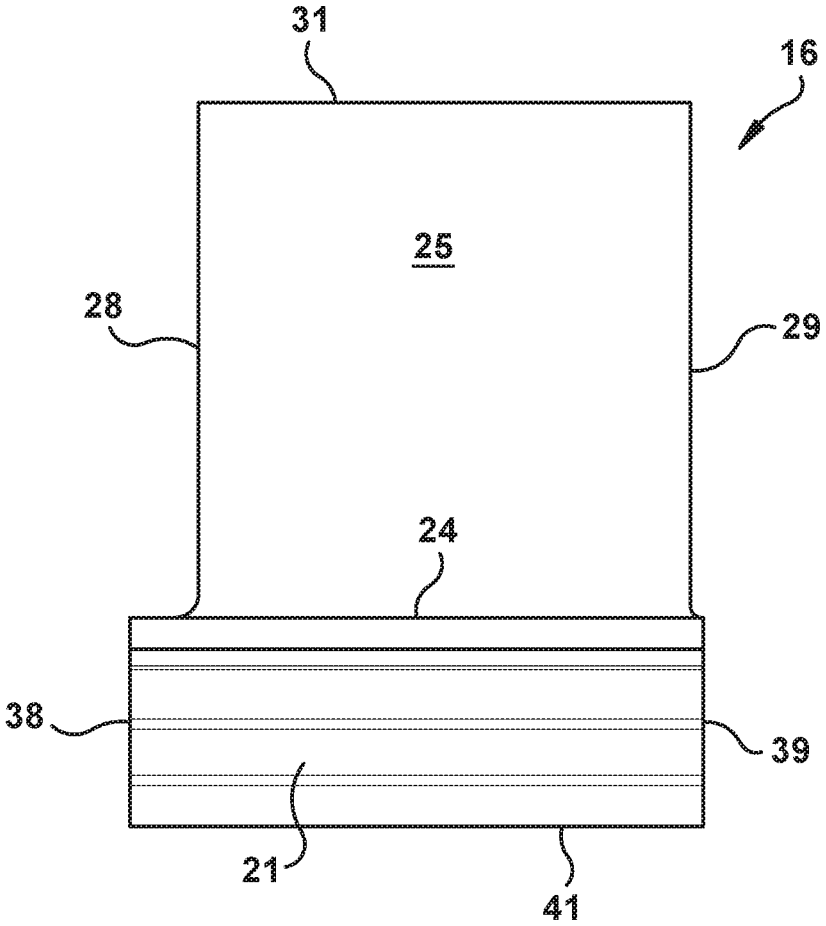
FIG. 4 is a side view of the rotor blade shown in FIG. 2 taken along the line 4-4.

Aspects and advantages of the present application are set forth below in the following description, or may be obvious from the description, or may be learned through practice of the invention. Reference will now be made in detail to present embodiments of the invention, one or more examples of which are illustrated in the accompanying drawings. The detailed description uses numerical designations to refer to features in the drawings. Like or similar designations in the drawings and description may be used to refer to like or similar parts of embodiments of the invention. As will be appreciated, each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. It is intended that the present invention covers such modifications and variations as come within the scope of the appended claims and their equivalents. It is to be understood that the ranges and limits mentioned herein include all sub-ranges located within the prescribed limits, inclusive of the limits themselves unless otherwise stated. Additionally, certain terms have been selected to describe the present invention and its component subsystems and parts. To the extent possible, these terms have been chosen based on the terminology common to the technology field. Still, it will be appreciated that such terms often are subject to differing interpretations. For example, what may be referred to herein as a single component, may be referenced elsewhere as consisting of multiple components, or, what may be referenced herein as including multiple components, may be referred to elsewhere as being a single component. Thus, in understanding the scope of the present invention, attention should not only be paid to the particular terminology used, but also to the accompanying description and context, as well as the structure, configuration, function, and/or usage of the component being referenced and described, including the manner in which the term relates to the several figures, as well as, of course, the precise usage of the terminology in the appended claims.

The following examples may be presented in relation to particular types of turbine engines. However, it should be understood that the technology of the present application may be applicable to other categories of turbine engines, without limitation, as would the appreciated by a person of ordinary skill in the relevant technological arts. Accordingly, unless otherwise stated, the usage herein of the term "turbine engine" is intended broadly and without limiting the usage of the claimed invention with various types of turbine engines, including various types of combustion or gas turbine engines as well as steam turbine engines.

Given the nature of how turbine engines operate, several terms prove particularly useful in describing certain aspects of their function. The terms "downstream" and "upstream" are used herein to indicate position within a specified conduit or flowpath relative to the direction of flow (hereinafter "flow direction") moving through it. Thus, the term "downstream" refers to the direction in which a fluid is flowing through the specified conduit, while "upstream" refers to the direction opposite that. These terms may be construed as referring to the flow direction through the conduit given normal or anticipated operation. Given the configuration of turbine engines, particularly the arrangement of the turbine section about a common shaft or axis, terms describing position relative to an axis may be regularly used herein. In this regard, it will be appreciated that the term "radial" refers to movement or position perpendicular to an axis. Related to this, it may be required to describe relative distance from the central axis. In such cases, for example, if a first component resides closer to the central axis than a second component, the first component will be described as being either "radially inward" or "inboard" of the second component. If, on the other hand, the first component resides further from the central axis than the second, the first component will be described as being either "radially outward" or "outboard" of the second component. As used herein, the term "axial" refers to movement or position parallel to an axis, while the term "circumferential" refers to movement or position around an axis. Unless otherwise stated or plainly contextually apparent, these terms should be construed as relating to the central axis of the turbine as defined by the shaft extending therethrough, even when these terms are describing or claiming attributes of non-integral components—such as rotor or stator blades—that function therein. Finally, the term "rotor blade" is a reference to the blades that rotate about the central axis of the turbine engine during operation, while the term "stator blade" is a reference to the blades that remain stationary.

Referring now to the drawings, wherein like characters designate like or corresponding parts throughout the several views, for background purposes, FIGS. 1 through 4 are provided. In FIG. 1 there is shown a portion of a circular array of rotor blades 16 disposed in a portion of a rotor disc or wheel 19. As shown best in FIGS. 2, 3 and 4, each rotor blade 16 generally includes a root 21, which connects the rotor blade 16 to the rotor wheel 19, and, extending from the root 21, an airfoil 25, which is the active component of the rotor blade 16 that intercepts the flow of working fluid through the flowpath of turbine and induces the desired rotation.

The airfoil 25 of the rotor blade 16 typically includes a concave pressure face 26 and a circumferentially or laterally opposite convex suction face 27. The pressure face 26 and suction face 27 may extend axially between opposite leading and trailing edges 28, 29, respectively, and, in the radial direction, between an inboard end, which may be defined at the junction with a platform 24, and an outboard tip 31. The airfoil 25 may include a curved or contoured shape that is designed for promoting the desired aerodynamic performance. The platform 24, as shown, generally forms the junction between the root 21 and the airfoil 25, and thus the inboard end of the airfoil 25. As will be appreciated, the platform 24 also may define a section of the inboard boundary of the working fluid flowpath of the turbine.

Figure 5:
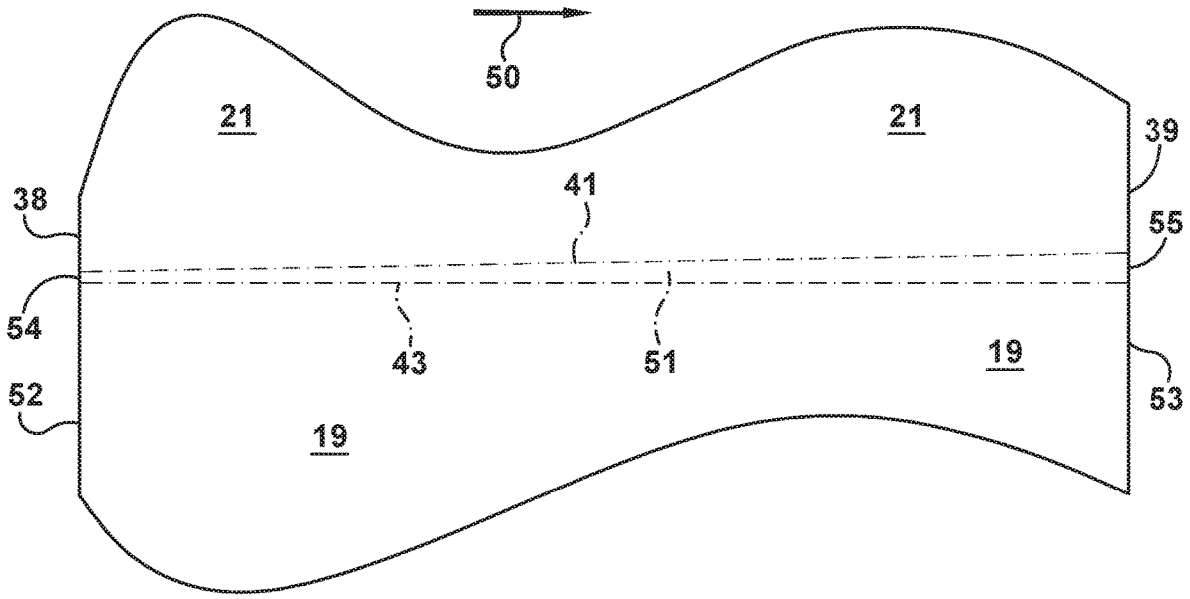
FIG. 5 is a simplified side view of an exemplary shim cavity that may be formed between the root of a rotor blade and a rotor wheel in accordance with the present invention.
Figure 6:
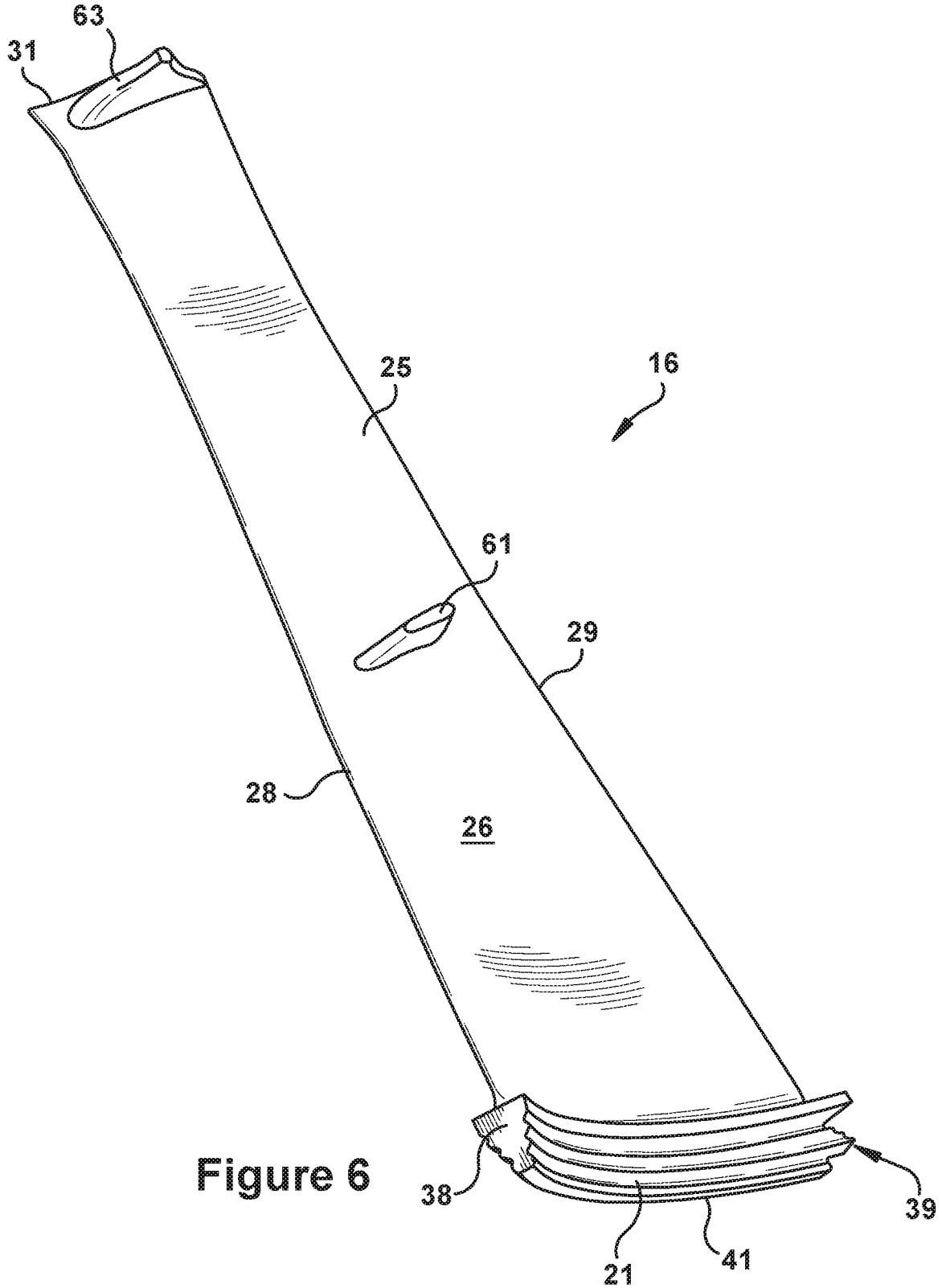
FIG. 6 is a perspective view of an exemplary late stage rotor blade with which the present invention may be used.

The rotor blade 16 may be connected to the rotor wheel 19 via a connection assembly formed therebetween. As part of conventional design, the root 21 may be formed as dovetail or "fir tree" shaped connector that engages a correspondingly shaped slot 20 formed in the rotor wheel 19. In such connection assemblies, as shown, the root 21 and the slot 20 each include a number of projections or teeth that register with grooves formed within the other. In this way, a number of contact surfaces are created between the root 21 and the slot 19 so that operational stresses are spread. The slot 20 within the rotor wheel 19 may be axially oriented, or approximately so, so that the root 21 of the rotor blades 16 engages or is installed therewithin via an axially sliding motion. As discussed more below, to prevent axial movement of the rotor blade 16 once it is installed, an axial retainment feature may be provided. As shown in FIGS. 5 and 6, the root 21 may be curved, generally described by a convex arcuate surface and a concave arcuate surface. The slot 20 may correspond in shape. The root 21 and slot 20 may be linear as well, in which case, they may be formed either parallel to the central axis of the turbine or tangentially skew relative thereto.

As used herein, the root 21 is described as having an inlet side or upstream face 38, which corresponds with the leading edge 28 of the airfoil 25, and an exit side or downstream face 39 that corresponds with the trailing edge 29 of the airfoil 25. Additionally, as used herein, the root 21 includes a bottom or inboard most edge or face that is referred to as a bottom face 41 of the root 21. As further indicated in FIG. 1, the inboard most portion or surface of the rotor wheel 19 that defines the slot 20, which, as shown, is opposite of the bottom face 41 of the root 21, is referred to herein as the floor 43 of the slot 20.

As stated, the size of the rotor blades within the several stages of a turbine generally increases as the rows of rotor blades progress in the downstream direction. As a result, the rotor blades within these later stages of the turbine have considerable length and weight, which typically creates restrictive spatial considerations that must be taken into account during the installation of the rotor blades within a row. The length and weight of such rotor blades also result in particular structural and retainment issues for the rotor blades during operation, which often necessitate the use of interlocking tip and/or midspan shrouds.

Turbine rotor blades are typically connected to the rotor wheel via particular types of connectors (which may also be referred to herein as "connection assemblies"). As already described, such connectors typically include the root of the rotor blade having a shaped profile, such as a dovetail or "multi-tang" fir tree shape, that engages a correspondingly shaped slot formed through an outer perimeter of the rotor wheel. Such shaped connectors are configured like this to provide a number of stress-spreading contact surfaces between the root of the rotor blade and the slot of the rotor wheel. Once these contact surfaces are engaged, relative movement between the rotor blade and the rotor wheel is substantially restrained. According to conventional designs, however, such connection assemblies between rotor blades and rotor wheels are often made to have a certain degree of "play" or "excess room" in the radial direction, which allows the installed rotor blades at least some movement in this direction relative to the rotor wheel.

During high speed operation, it will be appreciated that such excess room in the radial direction does not result in the rotor blades moving within the connection assembly due to the centrifugal forces that drive the rotor blade in an outboard direction. However, during low speed operation—such as turning gear operation—the excess room in the radial direction results in the rotor blades moving or jostling in the radial direction as they rotate. While this movement is generally undesirable due to the wear it causes to the contact faces of the root and slot, the excess room is nonetheless necessary for facilitating the assembly of the rotor blades. Specifically, the excess room allows some movement or "fanning" of rotor blades that is needed during the assembly of the row. One of the reasons for this is the interlocking features that are present at the outboard tips or midspan of the airfoils, which are needed for support and to reduce vibrations. Further, the airfoil portions of the rotor blades may overlap such that the assembly of the last rotor blades in the row is made difficult, if not impossible, unless a certain amount of movement is not maintained within the connection assemblies.

Given these considerations, certain novel connection assemblies for connecting a row of rotor blades to a rotor wheel will now be described. With general reference to FIGS. 10 through 13, these connection assemblies include a particular shim 49 arranged between the root 21 of a rotor blade 15 and the slot 20 of the rotor wheel 19. As will be seen, the connection assemblies of the present invention permit some relative movement for efficient installation of the blades, but then are conveniently modified via use of the shim 49 so that the relative motion is restrained thereafter. Specifically, the present connection assemblies include the use of an elongated tapered shim 49 that is installed within a defined shim cavity 51 to restrain radial movement once the rotor blades 16 have attained a fully assembled position. In this manner, the installation of the rotor blades 16 may be completed with the advantages provided by the "excess room", while then being modifiable to prevent the cyclic movement or jostling during low speed operation, which damages various contact surfaces between the rotor blade 16 and the rotor wheel 19. As such cyclic movement also induces wear to the other interlocking features that are used between rotor blade airfoils 25—such as interlocking tip shrouds or midspan shrouds—the present invention also may be used to prevent damage in areas of the rotor blade 16 other than the root 21.

In accordance with exemplary embodiments, FIG. 5 provides a schematic side view of an exemplary shim cavity 51 that may be formed between the root 21 of a rotor blade 16 and the rotor wheel 19. That is, the present invention describes a connection assembly by which rotor blades 16 are connected to a rotor wheel 19 that includes an axially extending shim cavity 51 formed between opposing exterior surfaces of the root 21 and the slot 20. Within this shim cavity 51, as will be seen, a shim 49 may be used that restrains the radial movement of the rotor blade 16 relative to the rotor wheel 19 once installation is complete. Pursuant to exemplary embodiments, the exterior surface of the root 21 that defines the shim cavity 51 is the bottom face 41 of the root 21. The bottom face 41 of the root 21 may be defined as the radially innermost surface of the root 21. The exterior surface of the slot 20 that defines the shim cavity 51 is the floor 43 of the slot 20. According to preferred embodiments, the floor 42 is defined as a radially innermost exterior surface of the rotor wheel 19 that defines the slot 20.

In further describing the shim cavity 51, it may be helpful to define the axial faces of the rotor wheel 19. As used herein, these are designated as an upstream face 52 and a downstream face 53, which are so designated relative to the flow direction of the working fluid 50 through the flowpath of the turbine. Alternatively, the upstream face 52 and downstream face 53 of the rotor wheel 19 are defined, respectively, relative to the corresponding upstream face 38 and downstream face 39 of the rotor wheel 19 (which coincide, respectively, with the leading edge 28 and trailing edge 29 of the airfoil 25). According to preferred embodiments, the upstream face 38 of the root 21 may be coplanar with the upstream face 52 of the rotor wheel 19, while the downstream face 39 of the root 21 may be coplanar with the downstream face 53 of the rotor wheel 19. As shown, a longitudinal axis of the shim cavity 51 may extend between the upstream face 52 and the downstream face 53 of the rotor wheel 19, as well as between the upstream face 38 and downstream face 39 of the root 21 of the rotor blade 16. Consistent with these designations, the shim cavity 51 may be further described as extending between upstream and downstream openings 54, 55, with the upstream opening 54 being the one that is generally coplanar with the upstream faces 38, 52 of the root 21 and rotor wheel 19, and the downstream opening 55 being the one that is generally coplanar with the downstream faces 39, 53 of the root 21 and rotor wheel 19.

According to preferred embodiments, the shim cavity 51 is configured with a tapering height that tapers gradually between a first height that is greater than a second height (which also may be referred to herein simply as a "greater height" and "lesser height"). As illustrated, the first or greater height of the shim cavity 51 may occur at the downstream opening 55. The shim cavity 51 may have a maximum height at the downstream opening 55. The second or lesser height of the shim cavity 51 may occur at the upstream opening 54. The shim cavity 51 may have a minimum height at the upstream opening 54. The taper angle of the shim cavity 51 may be gradual or shallow, for example, within a range of 0.4 to 1.0 degrees. As will be appreciated, the taper angle of the shim cavity 51 may be made to correspond to the taper of the shim 49, as discussed more below. As an example, the height of the shim cavity 51 at the downstream opening 55 may be between 0.25 and 0.35 inches, while the height of the shim cavity 51 at the upstream opening 54 may be between 0.05 and 0.15 inches. Though these dimensions may vary substantially based on varying rotor blade to rotor wheel configurations. According to preferred embodiments, the taper of the shim cavity 51 is produced via an angling of the bottom surfaced 41 of the root 21. In such cases, a radial height of the root 21 may be described as decreasing or tapering in accordance with the desired taper within the shim cavity 51 as the root 21 extends between its upstream and downstream faces 38, 39.

Figure 7:
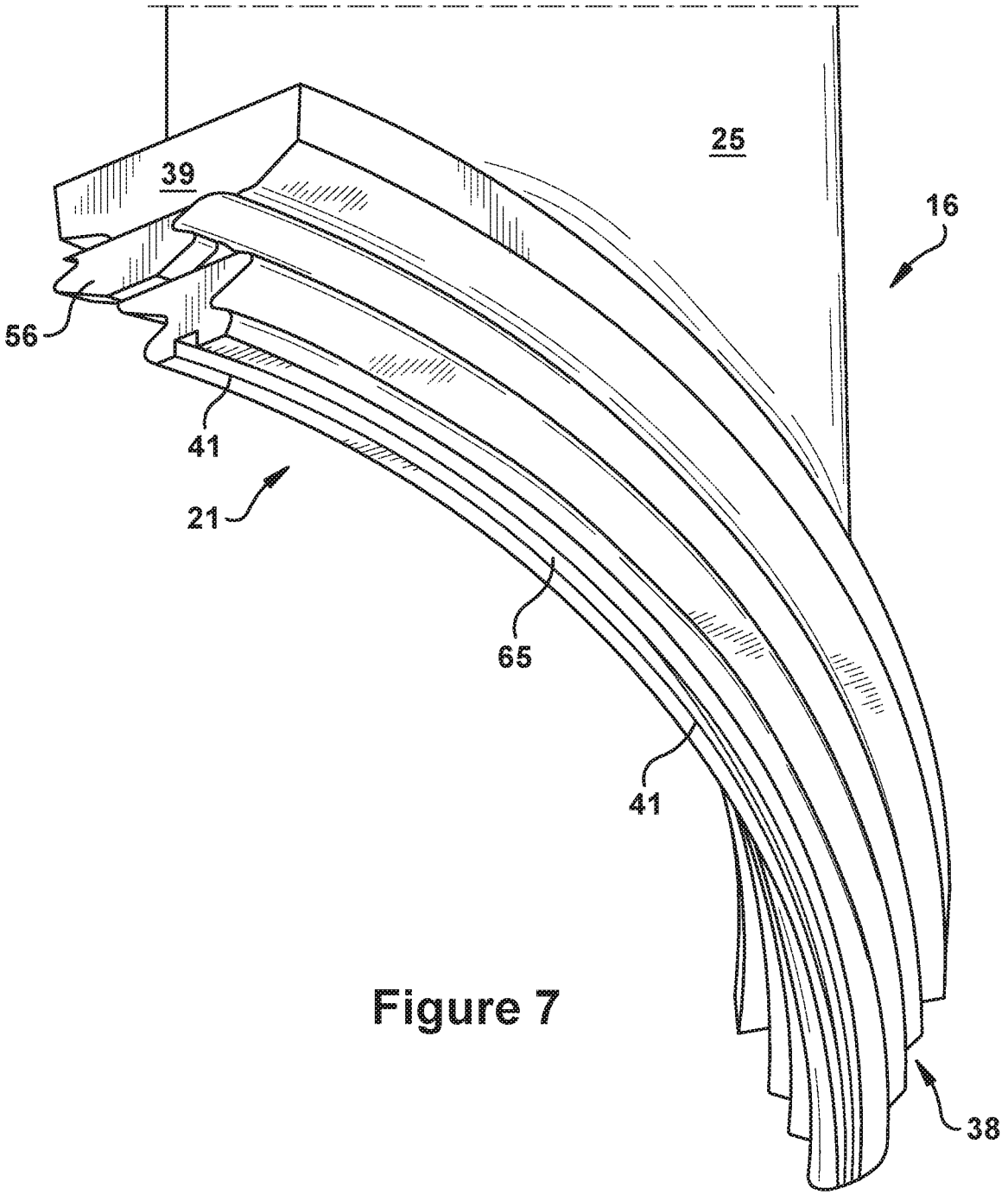
FIG. 7 is a perspective view of the underside of the root of a rotor blade in accordance embodiments of the present invention.

With reference now to FIGS. 6 and 7, perspective views are provided of exemplary late stage rotor blades 16 that may be used with the connection assemblies of the present invention. As will be appreciated, the airfoil 25 of such rotor blades 16 are considerably longer compared to those of rotor blades in more forward stages. Because of this, such rotor blades 16 may include shrouds, such as the illustrated midspan shroud 61 and tip shroud 63. Such shrouds 61, 63 may form interlocking engagements or points of contact between neighboring rotor blades 16 within a row. In doing so, the shrouds 61, 63 provide support to the long blades and, thereby, reduce harmful vibrational responses during operation. However, as mentioned, such shrouds 61, 63 may complicate installation of the rotor blades, which is one of the reasons why the "excess room" may be provided within rotor blade/rotor wheel connection assemblies, as this movement may allow the "fanning" of the blades needed to properly align them during installation. However, as stated, if this excess room remains after installation, the resulting movement or jostling of the rotor blades during low speed operation can damage these shroud connections.

In accordance with exemplary embodiments of the present invention, FIG. 6 provides an inboard perspective of the bottom or underside of the root 21 of a late stage rotor blade 16. As shown, the root 21 includes a shaped or profiled cross-section—for example, a dovetail or fir tree configuration—which is made to functionally correspond to the cross-sectional shape of the slot 20 formed in the perimeter of a rotor wheel 19. As further illustrated, the downstream face 39 of the root 21 includes an axial retainment feature 56 that may be used in conjunction with a lockwire (not shown) for retaining the root 21 of the rotor blade 16 within the slot 20.

With continued reference to FIG. 7, the exterior surface of the root 21 that defines the shim cavity 51 is the bottom face 41 of the root 21, which, as stated, may be defined as the radially innermost surface of the root 21. According to exemplary embodiments, as illustrated, the bottom face 41 of the root 21 may include several characteristics that improve the robustness and functionality of the connection assembly. First, as stated above, the radial height of the root 21 may decrease gradually or taper as the root 21 extends between the upstream and downstream faces 38, 39. Per exemplary embodiments, this tapering may be achieved via an angling of the bottom face 41. Thus, as shown, the bottom face 41 of the root 21 may angle downward or inboard as the bottom face 41 extends between the downstream face 38 and upstream face 38 of the root 21. Second, as an alternative feature or one used in conjunction with the angling bottom face 41, the present invention may include a shallow groove or "bottom groove 65" that is formed on the bottom face 41 of the root 21. The bottom groove 65 may run lengthwise on the bottom face 41 and, generally, function to engage the shim 49 so to maintain the shim 49 in a desired center location within the shim cavity 51. For example, the bottom groove 65 may be configured to maintain the shim 41 tangentially in the correct location during transient operation where the root 21 of the rotor blade 16 does not maintain intimate contact with the rotor wheel 19. According to preferred embodiments, the bottom groove 65 may decrease in depth gradually as it nears the upstream face 38 of the root 21, thus having a greater depth near the downstream face 39. Third, as also shown, the bottom face 41 may narrow as it extends between the downstream face 38 and upstream face 38 of the root 21. That is, the bottom face 41 may taper in width from a greater width to a lesser width as it nears the upstream face 38.

Figure 8:
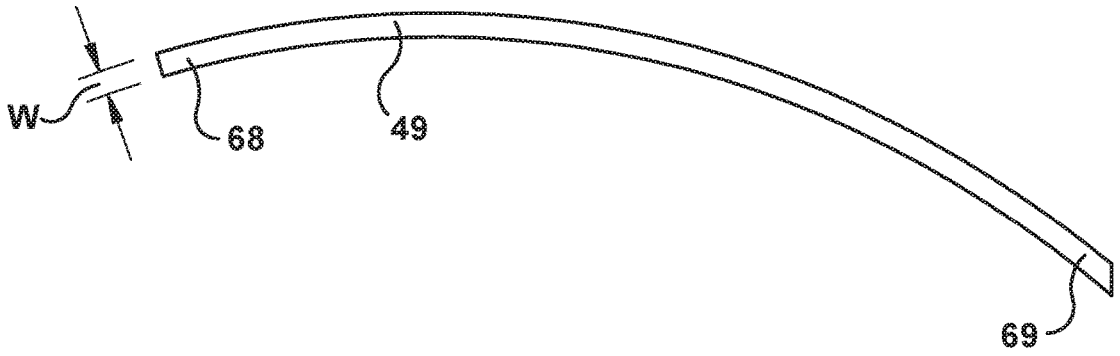
FIG. 8 is a top view of an exemplary shim in accordance with the present application.
Figure 9:
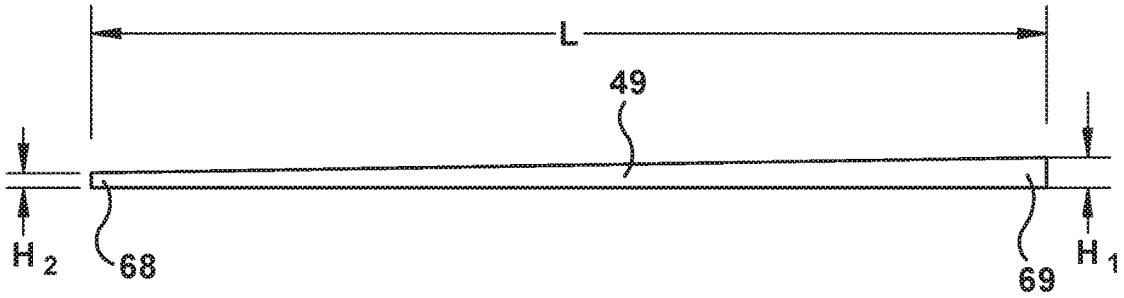
FIG. 9 is a side view of an exemplary shim in accordance with the present application.

FIGS. 8 and 9 provide views of an exemplary shim 49 in accordance with the present invention. FIG. 8 shows a top view of the shim 49, in which it is curved in accordance with the curved axis of the shim cavity 51 for which it is intended. It will be appreciated that, in cases where the slot 20 and root 21 (and resulting shim cavity 51) are linear instead of curved, the shim 49 be similarly configured. As shown in FIG. 8, the width of the shim 49 may be constant. According to an alternative embodiment, the width of the shim 49 may vary in accordance with the tapering width of the bottom face 41 of the root 21, as the bottom face 41 is shown in FIG. 7. The bottom groove 65 of the bottom face 41 of the root 21 may be configured to have a width that corresponds to the width of the shim 49 for promoting the functionality described above.

As shown in FIG. 9, the shim 49 is elongated and includes a height differential between thin and thick ends 68, 69. This shim 49 thus may be described as having a wedge shape.

Specifically, the shim 49 may taper gradually between the think end 69 and the thin end 68. Thus, the shim 49 may have a maximum height at the thick end 69, which, upon installment into the shim cavity 51, will be disposed at the downstream opening 55. The shim 49 may have a minimum height at the thin end 68, which, upon installment into the shim cavity 51, will be disposed near the upstream opening 54. The taper angle of the shim 49 may correspond to the shallow taper angle of the shim cavity 51 to promote snug installation thereinto. Thus, the taper angle of the shim 49 may be a gradual or shallow one, for example, within a range of 0.4 to 1.0 degrees. As an example, the height of the shim 49 at the thick end 69 may be between 0.25 and 0.35 inches, while the height of the shim 49 at the thin end 68 may be between 0.05 and 0.15 inches. Though these dimensions may vary substantially based on varying rotor blade to rotor wheel configurations, as well as the size and shape of the shim cavity 51. The shim 49 may be conveniently manufactured of a durable metal, such as stainless steel, or other material capable of withstanding the thermal and mechanical stresses within the turbine engine. Though other configurations are possible, the shim 49 may have a rectangular cross-sectional shape that includes flat surfaces for engaging both the bottom face 41 of the root 21 and the floor 43 of the slot 20.

Figure 10:
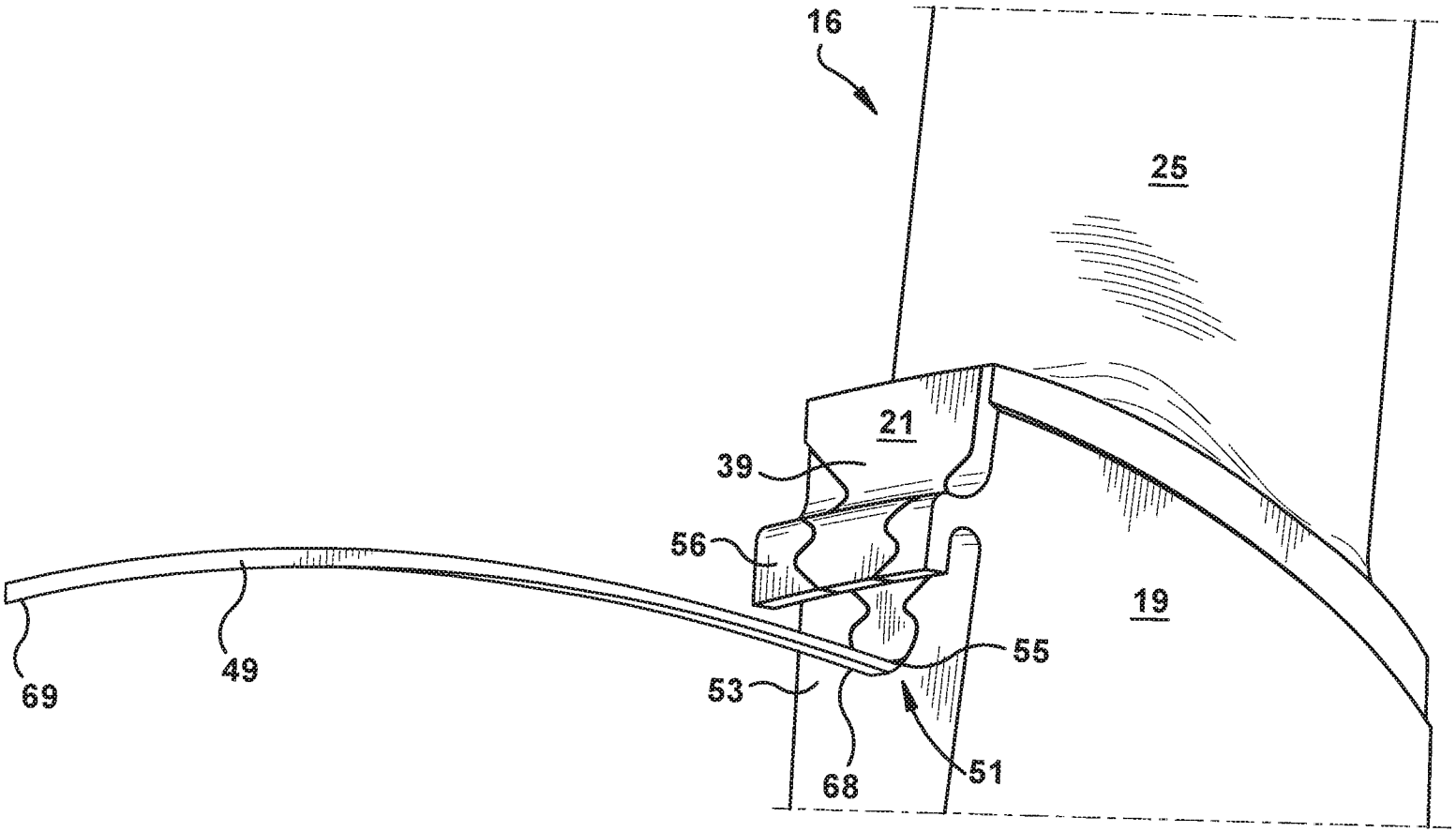
FIG. 10 is a perspective view of a rotor blade/rotor wheel assembly with shim that demonstrates a method of installation in accordance with the present invention.
Figure 11:
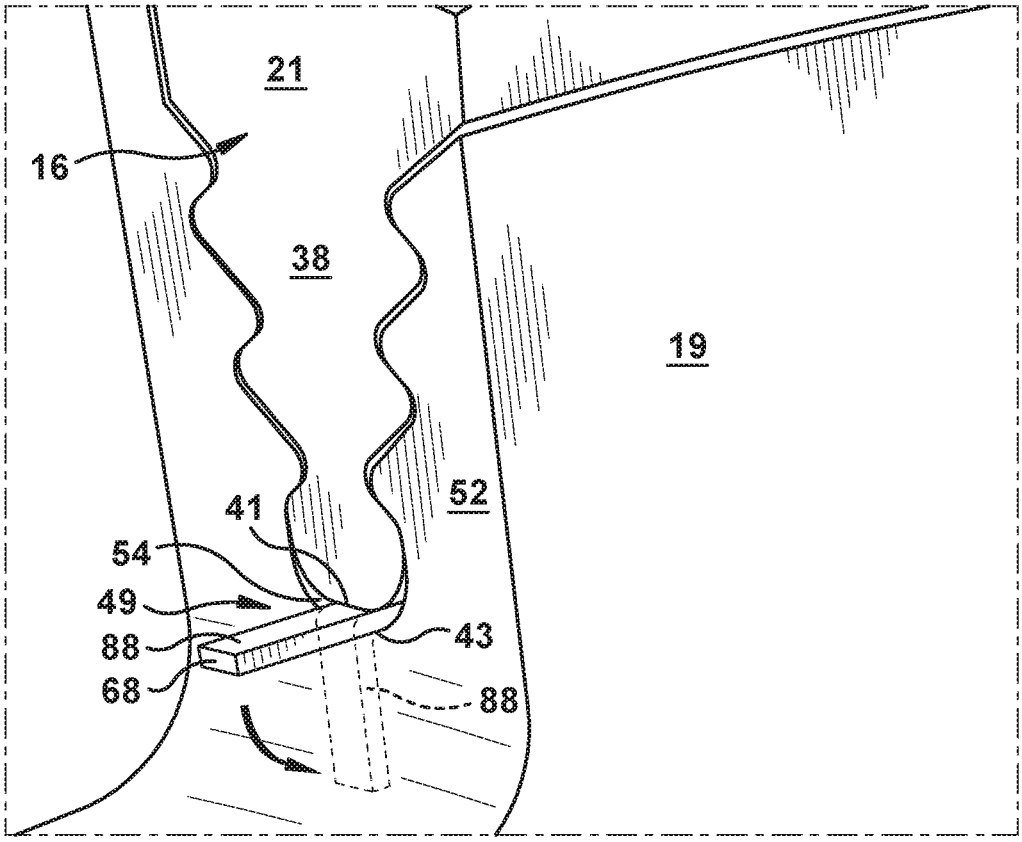
FIG. 11 is a perspective view of a rotor blade/rotor wheel assembly with shim that demonstrates a method of installation in accordance with the present invention.
Figure 12:
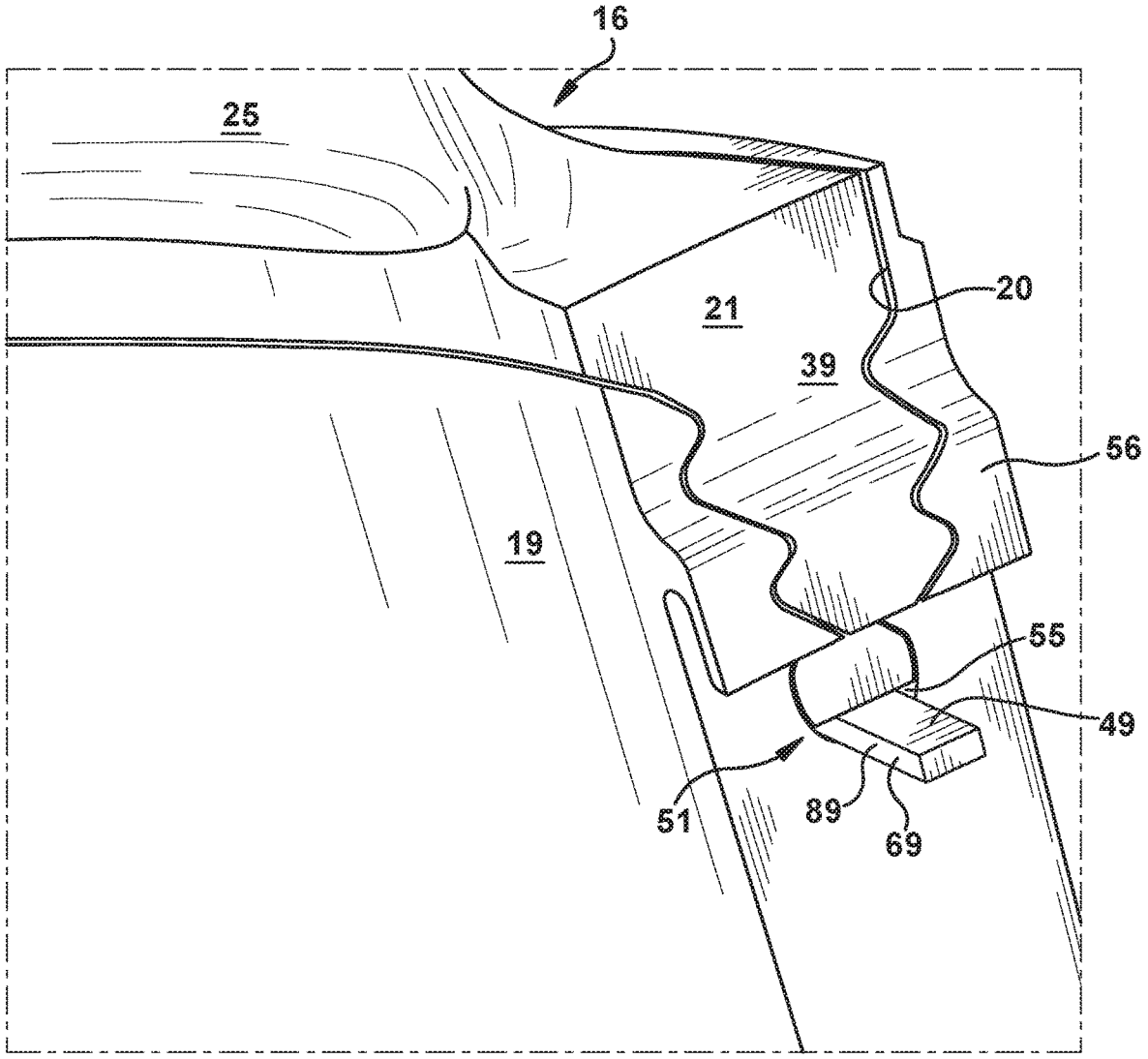
FIG. 12 is a perspective view of a rotor blade/rotor wheel assembly with shim that demonstrates a method of installation in accordance with the present invention.

With references now to FIGS. 10 through 12, perspective views are provided that illustrate the present rotor blade/rotor wheel connection assembly, while also demonstrating a method of installation in accordance with other aspects of the present invention. As previously described, conventional technology of using springs or, alternatively, overly tight dovetail fits each has limitations that are undesirable for use with the longer and heavier rotor blades in the later stages of the turbine. Spring add complexity and stresses to the assembly and complicate installation, whereas overly tight connectors eliminate the relative movement between the rotor blade and rotor wheel that is needed for efficient installation. Such tight connectors lack the degree of flexibility within the connection that is required to get the last few rotor blades—often referred to as the "closure group"—assembled within the row.

The present invention, as demonstrated in FIGS. 10 through 13, proposes the use of an elongated tapered shim 49 that is installed after the blades are positioned on the rotor wheel. Once installed, the shim 49 then function to both retain the rotor blade 16 axially as well as radially, limiting the damaging radial movement of the rotor blade 16 during low speed operation or operation while on turning gear.

As shown in FIG. 10, the rotor blades 16 are engaged within the slot 20 of the rotor wheel 19 prior to the insertion of the shim 49. According to one method of installation, the shim 49 may be installed in succession with each individual rotor blade, until, that is, the last few (5-10%) of the rotor blades are engaged, as these are the ones that typically require the movement or "fanning" to be properly positioned within the row. Once this last "closure group" is in place on the rotor wheel 19, the shims 49 can be inserted for each within the group.

As shown, the shims 49 are installed by inserting the thin end 68 of the shim 49 into the shim cavity 51 via the larger downstream opening 55. If necessary, the shim 49 then may be tapped into place from the downstream faces 39, 53 of the stage (also known as the exit side). (It should be appreciated that entrance side designs are also feasible.) Thus, a force may be asserted against the thick end 69 of the shim 49, such as by tapping, until the shim 49 has attained a fully inserted position within the shim cavity 51.

FIG. 11 shows the upstream face (also known as the entrance side) of the connection assembly during the installation process of the shim 49. According to alternative embodiments, as illustrated, the shim 49 may have a length such that, once it is fully inserted, a portion of the thin end 68 extends beyond the upstream opening 54 of the shim cavity 51. This exterior segment 88 may trimmed, or, alternatively, as indicated in FIG. 11, the exterior segment of the thin end 68 may be bent (see portion represented by dotted lines). To do this, the exterior segment 88 of the thin end 68 of the shim 49 is bent at approximately a right angle via hammering or some other such process. The exterior segment 88, once bent in this manner, may then be allowed to remain in that position, i.e., is just exterior to the upstream opening 54 of the shim cavity 51. In this position, the exterior segment 88 may abut and extend parallel to the upstream face 52 of the rotor wheel 19. In this way, the exterior segment 88 may restrain axial movement of the shim 49 in the downstream direction, which prevents the thin end 68 of the shim 49 from being drawn back into the upstream opening 54 of the shim cavity 51. As will be appreciated, given the direction of taper of the shim 49, the bent exterior segment 88 also functions to restrain axial movement of the rotor blade 16 in the downstream direction.

FIG. 12 shows the downstream face of the connection assembly (or exit end) after the shim 49 has been fully inserted within the shim cavity 51. As represented, the shim 49 may have a length such that, once it is fully inserted, a portion of the thick end 69 extends beyond the downstream opening 55 of the shim cavity 51. This exterior portion 89 may trimmed, or, alternatively, it may remain "as-is" if the amount extending beyond the downstream opening 55 is acceptable. As a further alternative, the exterior portion of the thick end 69 may be bent against the downstream face 53 of the rotor wheel 19 in a manner similar to that discussed above in regard to the thin end 68. This may be done to prevent the shim 49 from becoming overly tight in the shim cavity 51 via an upstream ratcheting process that may occur during operation. As further identified in FIG. 12, the slots 20 extend radially into and through a circumferentially extending perimeter face 70 of the rotor wheel 19.

Figure 13:
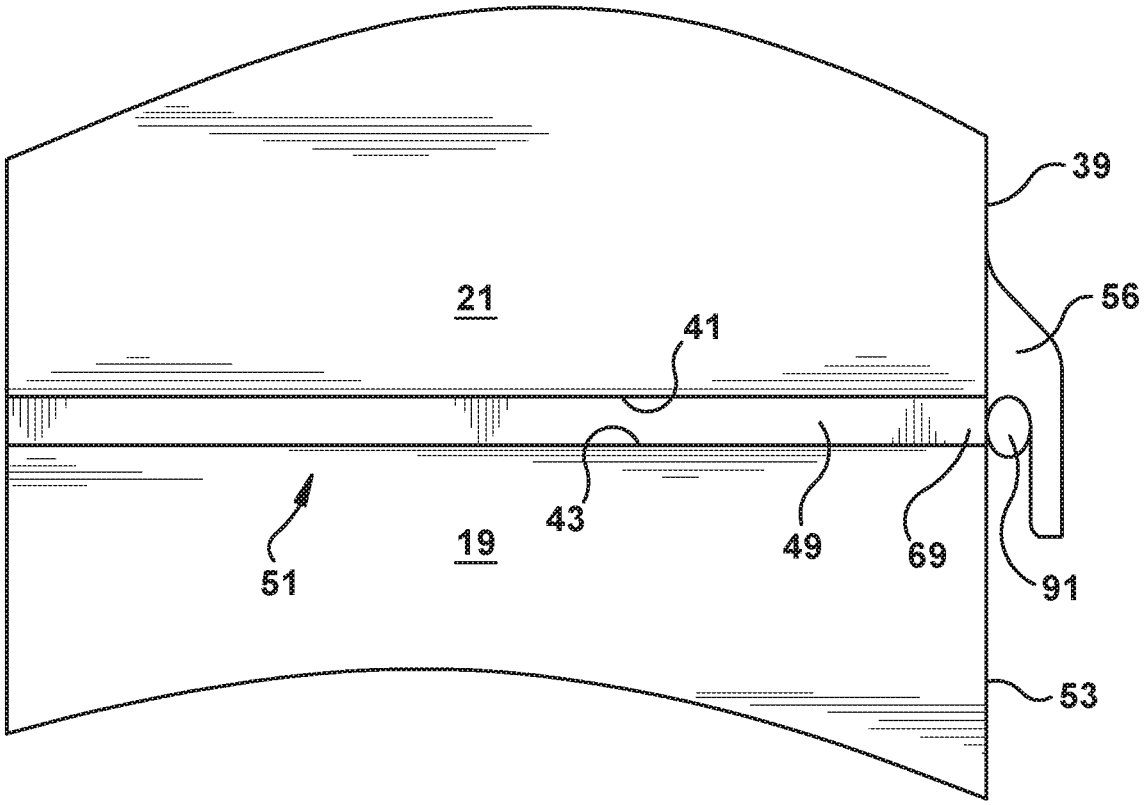
FIG. 13 is a simplified side view of a rotor blade/rotor wheel assembly with shim in accordance with an exemplary embodiment of the present invention.

FIG. 13 shows a simplified side view of the connection assembly of the present invention in which an axial retainment feature is used to retain the shim 49 within the shim cavity 51. In this case, the axial retainment feature 56 here is positioned such that the lockwire 91 (which is used in conjunction with it to axially restrain the rotor blade) resides at the radial height of the shim 49. In this way, the lockwire 91 may function both to axially restrain the root 21 of the rotor blade 16 as well as the shim 49. This axial retention feature may be used in conjunction with or as an alternative to the bent exterior segment 88 feature introduced above.

As one of ordinary skill in the art will appreciate, the many varying features and configurations described above in relation to the several exemplary embodiments may be further selectively applied to form the other possible embodiments of the present invention. For the sake of brevity and taking into account the abilities of one of ordinary skill in the art, each of the possible iterations is not provided or discussed in detail, though all combinations and possible embodiments embraced by the several claims below or otherwise are intended to be part of the instant application. In addition, from the above description of several exemplary embodiments of the invention, those skilled in the art will perceive improvements, changes and modifications. Such improvements, changes and modifications within the skill of the art are also intended to be covered by the appended claims. Further, it should be apparent that the foregoing relates only to the described embodiments of the present application and that numerous changes and modifications may be made herein without departing from the spirit and scope of the application as defined by the following claims and the equivalents thereof.

That which is claimed:

1. A turbine engine comprising:

rotor blades circumferentially arrayed about a rotor wheel;

a connection assembly by which each of the rotor blades connects to the rotor wheel, the connection assembly including:

an axially oriented slot formed through a perimeter face of the rotor wheel;

a root of the rotor blade installed within the slot, the root being shaped in relation to the slot such that the installation therein forms an axially extending shim cavity between opposing exterior surfaces of the root and the slot; and a shim installed within the shim cavity for restraining movement of the rotor blade relative to the rotor wheel in a radial direction, wherein the shim comprises a wedge shape, wherein the wedge shape is tapered from a thin end at an upstream face of the rotor wheel to a thick end at a downstream face of the rotor wheel, wherein the thin end of the shim comprises an exterior segment protruding outside of the shim cavity, wherein the exterior segment of the thin end is bent in a radially inward direction at an approximate right angle relative to an interior portion of the shim that resides inside of the shim cavity, the exterior segment of the thin end extending adjacent and parallel to the upstream face of the rotor wheel so to resist axial movement of the shim in a downstream direction, and wherein a body of the shim is curved convexly radially outward and the thick end and thin end are radially inward relative to the body of the shim.

2. The turbine engine according to claim 1, wherein the rotor blades each includes an airfoil, the airfoil comprising a pressure face and a laterally opposed suction face, the pressure face and the suction face extending: axially between opposed leading and trailing edges of the airfoil; and radially between an inboard end, at which the airfoil attaches to the root, and an outboard tip of the airfoil; and wherein the airfoils of the rotor blades extend radially into a working fluid flowpath defined through the turbine engine.

3. The turbine engine according to claim 2, wherein, relative to a flow direction of a working fluid through the working fluid flowpath during operation of the turbine engine:

the rotor wheel comprises the upstream face and the downstream face;

the root comprises an upstream face and a downstream face; and the shim cavity extends between an upstream opening and a downstream opening.

4. The turbine engine according to claim 3, wherein the slot extends axially between a profiled opening formed on each of the upstream face and the downstream face of the rotor wheel;

wherein:

the upstream face of the root resides approximately coplanar with the upstream face of the rotor wheel; and the downstream face of the root resides approximately coplanar with the downstream face of the rotor wheel.

5. The turbine engine according to claim 3, wherein the shim cavity comprises a tapering height that tapers between a greater height and a lesser height; and wherein:

the shim cavity comprises the greater height at the downstream opening; and the shim cavity comprises the lesser height at the upstream opening.

6. The turbine engine according to claim 5, wherein the exterior surface of the root that defines the shim cavity comprises a bottom face of the root, and the exterior surface of the slot that defines the shim cavity comprises a floor of the slot.

7. The turbine engine according to claim 6, wherein the bottom face comprises a bottom groove running lengthwise thereon for engaging and positioning the shim in relation to the bottom face.

8. The turbine engine according to claim 7, wherein the bottom groove comprises a width sized relative to a width of the shim for engagement of the shim therein, the bottom groove tapering in depth lengthwise between a greater depth near the downstream face of the root a lesser depth near the upstream face of the root;

wherein a longitudinal axis of the shim cavity extends between the upstream face and the downstream face of the rotor wheel; and wherein a longitudinal axis of the shim extends between the upstream face and the downstream face of the rotor wheel in parallel with the longitudinal axis of the shim cavity.

9. The turbine engine according to claim 6, wherein the bottom face of the root comprises a tapering width that tapers between a greater width and a lesser width;

wherein the bottom face comprises:

the greater width at the downstream face of the root; and the lesser width at the upstream face of the root.

10. The turbine engine according to claim 9, wherein a width of the shim tapers in accordance with the tapering width of the bottom face of the root.

11. The turbine engine according to claim 6, wherein the tapering of shim comprises a tapering height that tapers between:

a greater height at the thick end of the shim; and a lesser height at the thin end of the shim;

wherein the tapering height between the thick end and the thin end of the shim tapers in accordance with the tapering height of the shim cavity for snug insertion of the shim therein.

12. The turbine engine according to claim 11, wherein the shim comprises a maximum height at the thick end, the thin end being is disposed near the downstream opening of the shim cavity; and wherein the shim comprises a minimum height at the thin end, the thin end being disposed near the upstream opening of the shim cavity.

13. The turbine engine according to claim 12, wherein a taper angle of the tapering shim and shim cavity each comprises a range of 0.4 to 1.0 degrees; and wherein a height of the shim at the thick end comprises between 0.25 and 0.35 inches and a height of the shim at the thin end comprises between 0.05 and 0.15 inches.

14. The turbine engine according to claim 6, wherein the thick end of the shim comprises an exterior segment protruding outside of the shim cavity;

wherein the exterior segment of the thick end is bent at an approximate right angle relative to an interior portion of the shim that resides inside of the shim cavity, the exterior segment of the thick end extending adjacent and parallel to the downstream face of the rotor wheel so to resist axial movement of the shim in an upstream direction.

15. The turbine engine according to claim 6, wherein the connection assembly further comprises an axial retainer that includes a lockwire for axial retaining the root of the rotor blade within the slot; and wherein the lock wire comprises a position that abuts the thick end of the shim so to prevent the thick end of the shim from withdrawing from the downstream opening of the shim cavity.

16. The turbine engine according to claim 6, wherein the taper of the shim cavity comprises an angling of the bottom surfaced of the root; and wherein the slot is axially oriented relative to the rotor wheel, and the root is configured for slidably engaging the slot during installation.

17. The turbine engine according to claim 6, wherein the turbine engine comprises at least one of a steam turbine engine and a combustion turbine engine;

wherein the rotor blades comprise a last downstream row of rotor blades within the turbine engine;

wherein the root and slot comprise multiple corresponding pressure faces for arresting relative radial movement therebetween beyond a predetermined limit; and wherein the root and slot each comprises a longitudinal axis that is one of linear and curved.

18. A method of installing the rotor blades of a row of rotor blades onto a rotor wheel, wherein a connection assembly is used to connect each of the rotor blades to the rotor wheel, wherein the connection assembly comprises:

an axially oriented slot formed through a perimeter face of the rotor wheel;

a root of the rotor blade shaped in relation to the slot such that engagement of the root therein forms an axially extending tapering shim cavity between opposing exterior surfaces of the root and the slot; and a tapering shim, which tapers between a thick end and a thin end, installed within the tapering shim cavity for restraining movement of the rotor blade relative to the rotor wheel in a radial direction, wherein the tapering shim is shaped to correspond to the tapering shim cavity for snug installation thereinto;

wherein the method comprises the steps of:

axially engaging the root of the rotor blade within the slot of the rotor wheel;

with the root of the rotor blade engaged within the slot, adjusting a position the rotor blade relative to the rotor blades of the row of rotor blades that are adjacent to the rotor blade so that the rotor blade attains a final installed position;

engaging the thin end of the tapering shim within the tapering shim cavity;

applying force to the thick end of the tapering shim until full insertion into the tapering shim cavity is achieved;

bending an exterior segment of the thin end in a radially inward direction at an approximate right angle relative to an interior portion of the shim that resides inside of the shim cavity, the exterior segment of the thin end extending adjacent and parallel to the upstream face of the rotor wheel so to resist axial movement of the shim in a downstream direction; and curving a body of the shim convexly radially outward with the thick end and thin end radially inward relative to the body of the shim.

19. The method in accordance with claim 18, wherein the step of adjusting the position of the rotor blade so to attain the final installed position for the rotor blade comprises a fanning of the rotor blade; and wherein the tapering shim comprises a length wherein, upon achieving the full insertion into the tapering shim cavity, the thin end of the tapering shim comprises an exterior segment that protrudes from the tapering shim cavity;

further comprising the step of bending the exterior segment relative to an interior segment of the tapering shim that resides within the tapering shim cavity, the bending configured so that the exterior segment resists an axial movement of the tapering shim in a direction that would draw the exterior segment into the tapering shim cavity.

* * * * *